United States Patent [19]

Kreeger

[11] Patent Number: 4,597,338

[45] Date of Patent: Jul. 1, 1986

[54] PALLET

[75] Inventor: Elsmer W. Kreeger, Howell, Mich.

[73] Assignee: Pinckney Molded Plastics, Inc., Howell, Mich.

[21] Appl. No.: 671,316

[22] Filed: Nov. 14, 1984

[51] Int. Cl.[4] ..... B65D 19/18

[52] U.S. Cl. ..... 108/51.1; 108/56.1; 108/57.1; 108/902

[58] Field of Search ..... 108/51.1, 56.1, 57.1, 108/901, 902, 56.3; 206/386, 600

[56] References Cited

U.S. PATENT DOCUMENTS

| | | | |
|---|---|---|---|
| 3,307,504 | 3/1967 | Cloyd et al. . | |
| 3,664,271 | 5/1972 | Wolder et al. . | |
| 3,717,396 | 2/1973 | Dupree | 108/51.1 |
| 3,736,885 | 6/1973 | Freund | 108/51.1 |
| 3,757,704 | 9/1973 | Allgeyer et al. | 108/51.1 |
| 3,824,933 | 7/1974 | Lind . | |
| 4,189,125 | 2/1980 | Little | 108/901 |
| 4,316,419 | 2/1982 | Cupido | 108/901 |

FOREIGN PATENT DOCUMENTS

| | | | |
|---|---|---|---|
| 2530588 | 1/1976 | Fed. Rep. of Germany | 108/51.1 |

*Primary Examiner*—William E. Lyddane
*Assistant Examiner*—Mark W. Binder
*Attorney, Agent, or Firm*—Basile, Weintraub & Hanlon

[57] ABSTRACT

A pallet is assembled from two identical pallet halves of a molded plastic material, such as polypropylene. Each pallet half is formed with a rigid, rectangular, load supporting platform having symmetrically disposed rows of support posts and latching leg assemblies projecting vertically from one surface of the platform. The posts and legs are so located and dimensioned that the legs on one pallet half can be inserted into the posts of the other to snap lock the two halves into assembled relationship. Spaced skirt portions along each edge of the platforms engage those of the other pallet half to define forklift tine receiving openings in each side of the pallet.

2 Claims, 6 Drawing Figures

PALLET

BACKGROUND OF THE INVENTION

The present invention is directed to load-bearing pallets constructed of molded plastic material, such as polypropylene, etc. In particular, the present invention is directed to pallets of that type in which the pallet is formed from upper and lower halves, preferably of identical construction so that the halves can be formed in a single mold, and in which two identical halves can be assembled to each other in face-to-face relationship to form the completed pallet by relatively simple, interlocking, snap-fit latches.

Examples of pallets of this general type are found in the prior art. See, for example, U.S. Pat. No. 3,307,504 to Cloyd et al.; Wolder et al. U.S. Pat. No. 3,664,271; and Lind U.S. Pat. No. 3,824,933. The present invention is especially directed to a molded pallet construction which presents improvements over the prior art by providing increased rigidity, strength and load-supporting ability.

SUMMARY OF THE INVENTION

A pallet embodying the present invention is made up from identical upper and lower pallet halves which are formed of a molded polypropylene or similar thermoplastic material. Each pallet half includes a rigid, rectangular, load-supporting platform having a series of integrally formed, four-sided posts and four-sided latching leg assemblies projecting vertically from the inner side of the platform. The posts are arranged in uniformly spaced rows on one side of a longitudinal centerline of the platform and the latching legs are disposed in two or more parallel rows at the opposite side of that centerline so that when two pallet halves are located in vertical alignment with each other, the posts on one pallet half are vertically aligned with the latching legs on the other pallet half. The four-sided posts are hollow and open at their distal ends and dimensioned to slidably receive the latching legs of a mating pallet half. A rectangular opening is cut through two opposed sidewalls of each post adjacent its juncture with the platform, and the latching legs are formed with latch teeth which resiliently spring out into these openings when two pallet halves are pressed together with the posts of one pallet half seated against the inner side of the platform of the other pallet half.

Depending skirts are formed on each corner of the loading platform and a central skirt projects downwardly from the platform midway of each side of the assembled pallet. The skirts on the two pallet halves are disposed in edge-to-edge relationship with each other when the pallet is assembled, the spaces between the skirts at the corners and central portion of each side edge defining openings providing access for the tines of a forklift truck to transport the pallet. The central skirt portions on two adjacent side edges of a pallet half are formed with projecting tabs which slidably engage the inner side of the opposed central skirt portions of a mating pallet half to stiffen these central portions when the pallet is assembled.

Other features and objects of the invention will become apparent by reference to the following specification and to the drawings.

IN THE DRAWINGS

DESCRIPTION OF THE PREFERRED EMBODIMENT

Figure 2:
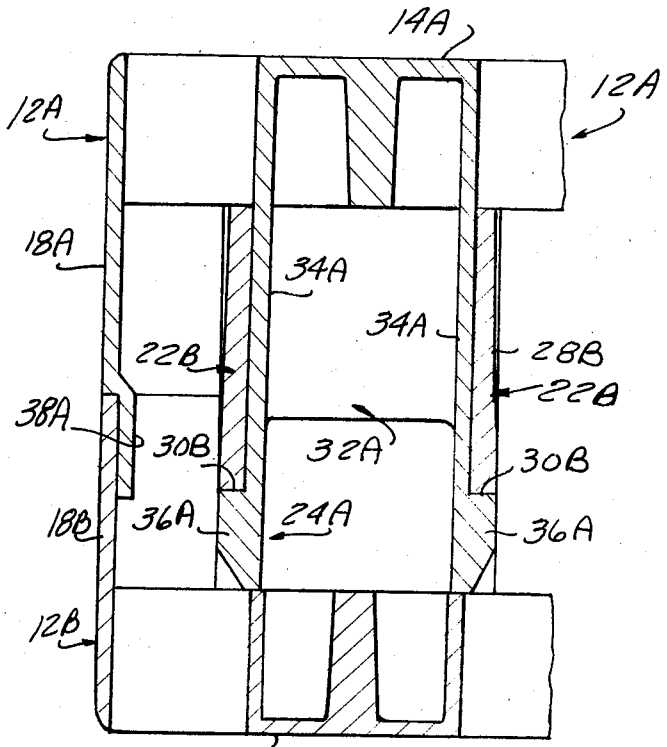
FIG. 2 is a detailed cross-sectional view taken on line 2—2 of FIG. 1.
Figure 1:
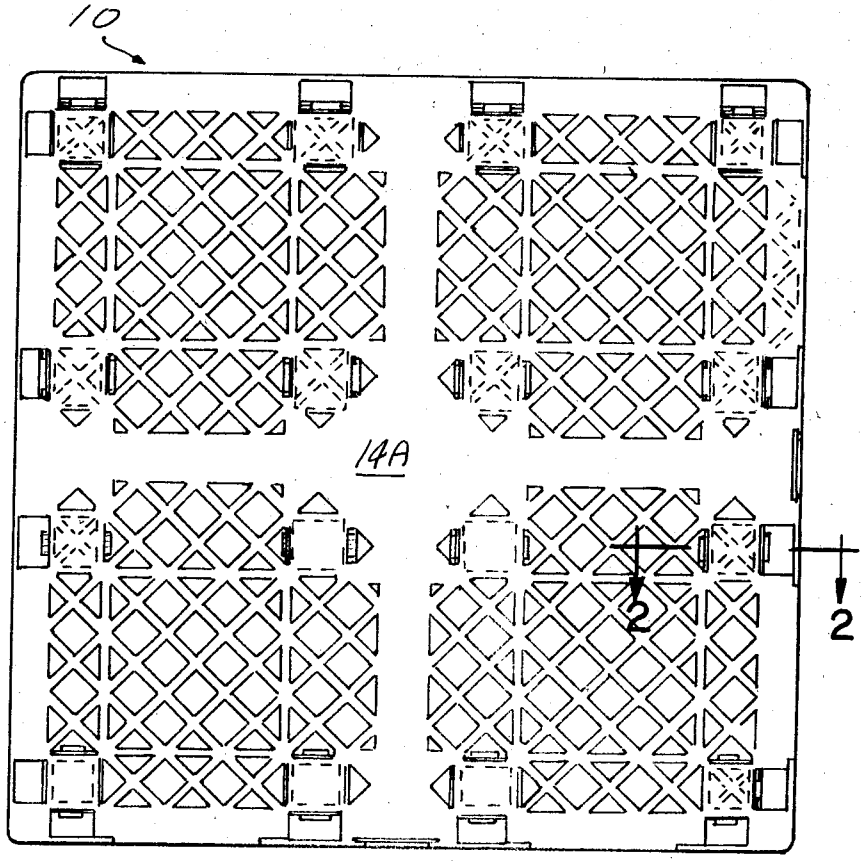
FIG. 1 is a top plan view of a pallet embodying the present invention.
Figure 3:
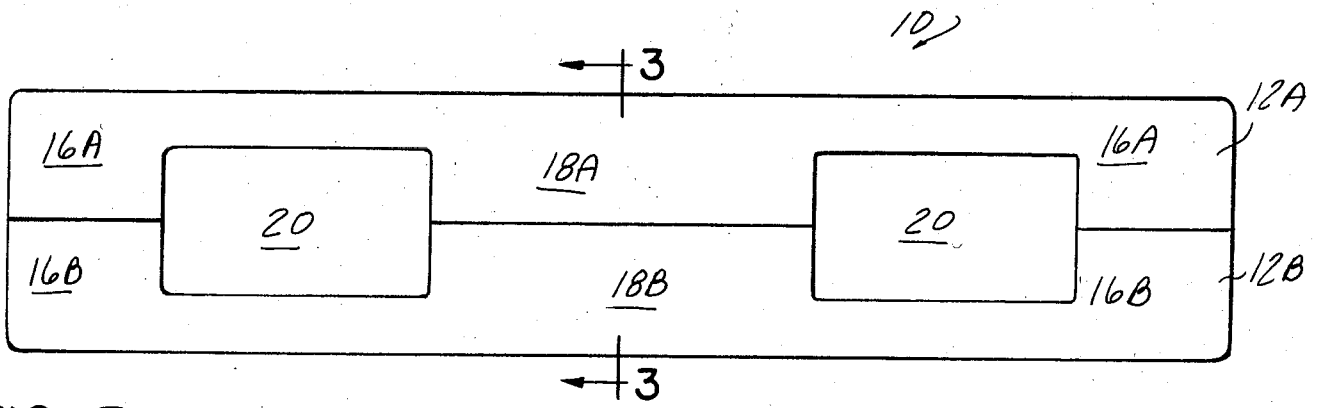
FIG. 3 is a side elevational view of the pallet of FIG. 1.

A pallet designated generally 10 embodying the present invention is shown in FIGS. 1–3 as being made up of two identical halves 12A, 12B formed of a molded plastic material, such as polypropylene. The two identical pallet halves 12A and 12B are formed in a manner to be described below such that they may be snap fitted together to form an intended permanent assembly.

Figure 6:
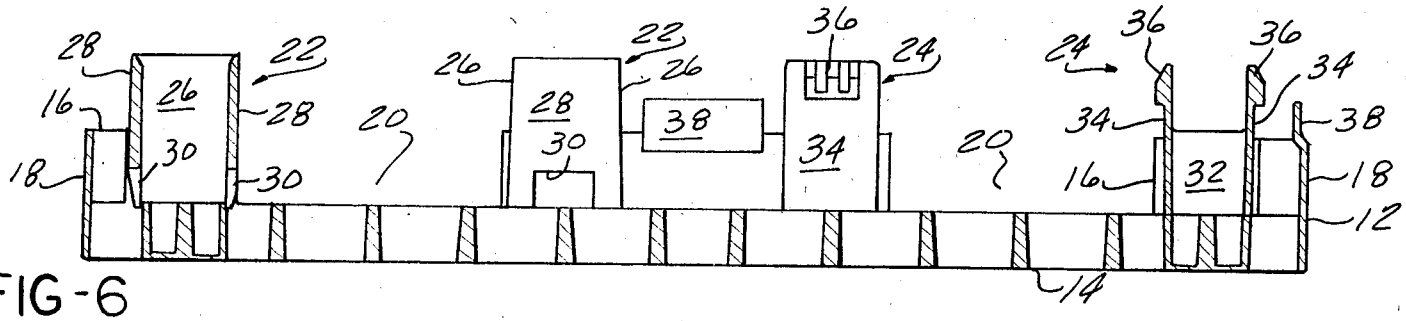
FIG. 6 is a cross-sectional view of one pallet half taken on the line 6—6 of FIG. 4.
Figure 5:
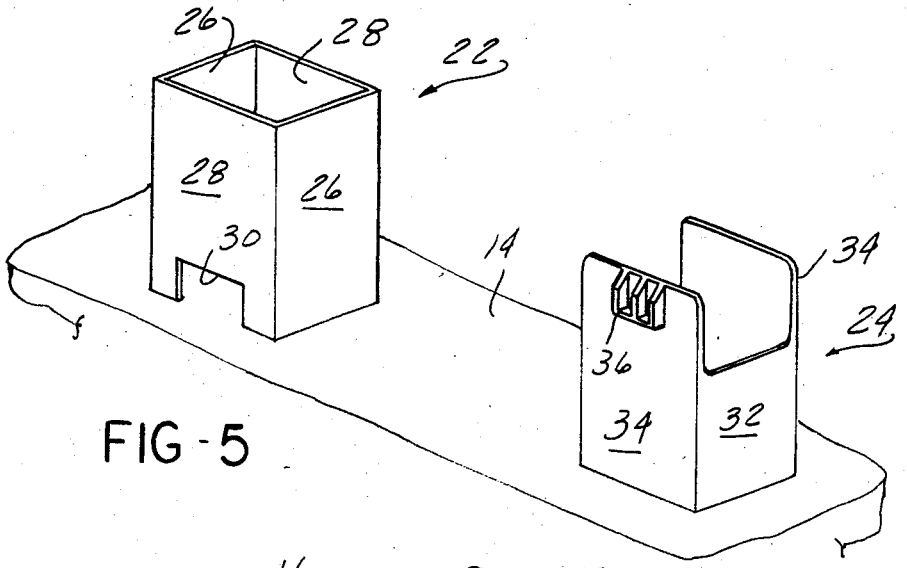
FIG. 5 is a partial perspective view of a post and a latching leg assembly of the pallet of FIG. 1.
Figure 4:
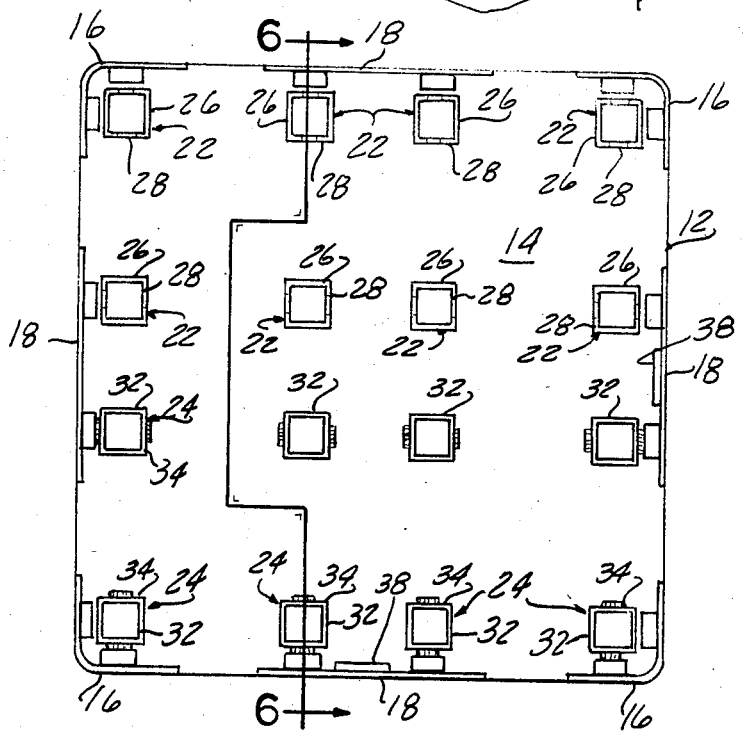
FIG. 4 is a schematic bottom view, with certain details omitted, of a pallet half showing the locations of the posts and latching leg assemblies.

FIGS. 4, 5 and 6 show a single pallet half which will be described in terms of reference numerals without subscripts A and B.

A pallet half 12 includes a flat, rectangular, load-supporting platform 14 which in FIGS. 4–6 is shown as being solid, but which, in practice, normally is formed with an open grid-like arrangement shown in FIG. 1.

As best seen in FIG. 6, skirt portions 16 and 18 project vertically from platform 14, the skirt portions 16 being located at each corner of the platform and extending a short distance along the two adjacent side edges, while the skirt portions 18 are disposed along the central portion of each side edge of the platform. The spaces 20 (see FIG. 3) between the ends of adjacent skirt portions 16 and 18 form forklift tine receiving openings in each side of the assembled pallet.

Also projecting vertically from platform 14 are a plurality of hollow support posts designated generally 22 and a plurality of coupling leg assemblies designated generally 24, the support posts 22 being arranged in two rows, see FIG. 4, located at one side of a centerline C of the load platform 14 and the coupling leg assemblies 24 being arranged in two rows on the opposite side of centerline C at positions matching those of the support posts.

Support posts 22 are formed with four integrally joined sidewalls, two opposed sidewalls 26 being continuous while the two remaining opposed sidewalls 28 are formed with rectangular openings 30 at the juncture of sidewalls 28 with platform 14.

Latching leg assemblies 24 are likewise formed with four integrally joined sidewalls, two opposed side walls 32 extending from platform 14 for only about one-half the height of the latching leg assemblies, while the two remaining sidewalls 34 extend to the full height of the latching leg assembly, which is equal to that of the support posts 22. At the distal end of each of sidewalls 34, an outwardly projecting latch tooth assembly 36 is formed on the outer side of each wall 34.

The outside dimensions of the sidewalls 32 and 34 of latching leg assemblies 24 are such that a latching leg assembly may be vertically inserted into the interior of a support post 22. The fit between the exterior walls of latching leg assemblies 24 and the interior walls of support posts 22 is a sliding fit. The cantilevered portions of the sidewalls 34 which project beyond the adjacent sidewalls 32 of the latching leg assembly 24 are sufficiently resilient so that when a latching leg assembly 24 is inserted into a support post 22, the cantilevered portions of walls 34 can flex inwardly enough to permit the latch teeth 36 to pass downwardly along the inner sides of walls 28 of the support posts 22 until the latch teeth 36 become aligned with the openings 30 in walls 28, at which time the latch teeth spring outwardly to snap into place in the manner shown in FIG. 2.

In FIG. 2, there is shown a cross-sectional view of a portion of an assembled pallet with a latching leg assembly 24B on the lower pallet half 12B fully seated within a support 22A of the mating pallet half 12A.

The skirt portions 18 on two adjacent sides of each pallet half are provided with inwardly offset and vertically projecting tabs 38 which, as best seen in the cross-sectional view of FIG. 2, slidably engage and support the central skirt portion 18 of the other pallet half.

It will be noted that when the two pallet halves 12A and 12B are assembled, the distal ends of the support posts 22 of one pallet half will be seated against the load platform 14 of the other pallet half while the sidewalls 34 of the latching leg assemblies of one half will likewise be engaged with the platform of the other pallet half.

While one embodiment of the invention has been described in detail, it will be apparent to those skilled in the art the disclosed embodiment may be modified. Therefore, the foregoing description is to be considered exemplary rather than limiting, and the true scope of the invention is that defined in the following claims.

I claim:

1. A pallet comprising a pair of like half pallet members coupled to each other in opposed, face-to-face relationship, each of said members comprising a rigid, horizontally disposed, rectangular main panel; a plurality of support posts and a like plurality of latching leg assemblies integral with and projecting vertically from the inner side surface of the main panel with the latching leg assemblies of one of said members being received within the support posts of the other member, the distal ends of the posts of one member being engaged with the inner surface of the main panel of the other member to maintain said main panels of the two members in a predetermined spaced relationship to each other; each of said posts being of like, square, tubular, horizontal cross section, each post having a generally rectangular opening through two opposed walls thereof adjacent the juncture of the post with its main panel, each latching leg assembly including a pair of flexible opposed legs received between the two opposed walls of the associated post; latch teeth on the outer side of each of said legs projecting into the rectangular opening of the associated post; a pair of corner skirts projecting vertically inwardly from said main panel at each end of each side of the panel and a central skirt portion projecting vertically inwardly from said main panel centrally of each side of the panel in spaced relationship to the adjacent corner skirts, said skirts of the respective members being in edge-to-edge engagement with each other with the spacing between said corner skirts and central skirts defining a pair of forklift tine receiving openings in each side of said pallet; and tabs integral with and projecting vertically from the inner sides of said central skirts on two adjacent sides of each member engaged with the inner sides of the central skirts of the other member.

2. The invention defined in claim 1 wherein said posts are located in a first pair of rows extending parallel to one side edge of said main panel and said latching leg assemblies are arranged in a second pair of rows extending parallel to said one side edge, the latch members and openings of one of each of said pairs of rows being on first sides of the respective posts and leg assemblies which are parallel to said one side edge and the remaining latch members and openings being on second sides of the respective posts and tubes which are perpendicular to said one side edge.

* * * * *